US009285111B2

(12) United States Patent
Todd, Jr.

(10) Patent No.: US 9,285,111 B2
(45) Date of Patent: Mar. 15, 2016

(54) LIGHTING FIXTURE FOR CEILING FAN

(71) Applicant: Alvin E. Todd, Jr., Pigeon Forge, TN (US)

(72) Inventor: Alvin E. Todd, Jr., Pigeon Forge, TN (US)

( * ) Notice: Subject to any disclaimer, the term of this patent is extended or adjusted under 35 U.S.C. 154(b) by 225 days.

(21) Appl. No.: 13/713,637

(22) Filed: Dec. 13, 2012

(65) Prior Publication Data

US 2013/0114245 A1 May 9, 2013

Related U.S. Application Data

(63) Continuation-in-part of application No. 12/862,417, filed on Aug. 24, 2010, which is a continuation-in-part of application No. 11/935,855, filed on Nov. 6, 2007, now abandoned.

(51) Int. Cl.

| | |
|---|---|
| ***F21V 33/00*** | (2006.01) |
| ***F04D 25/08*** | (2006.01) |
| ***F04D 29/58*** | (2006.01) |
| ***F04D 29/00*** | (2006.01) |

(52) U.S. Cl.

CPC ..... *F21V 33/0096* (2013.01); *F04D 25/088* (2013.01); *F04D 29/005* (2013.01); *F04D 29/582* (2013.01); *F04D 29/584* (2013.01)

(58) Field of Classification Search

CPC . F21V 33/0096; F04D 25/008; F04D 29/582; F04D 29/584; F04D 29/005

USPC ..... 362/92

See application file for complete search history.

(56) References Cited

U.S. PATENT DOCUMENTS

| | | | | |
|---|---|---|---|---|
| 332,821 | A | | 12/1885 | Murray, Jr. et al. |
| 1,226,734 | A | | 5/1917 | Work |
| 1,383,564 | A | | 7/1921 | Phillipson |
| 1,388,822 | A | | 8/1921 | Roys |
| 1,389,235 | A | | 8/1921 | Zieley |
| 1,399,931 | A | | 12/1921 | Clutts |
| 1,472,124 | A | | 10/1923 | Howe et al. |
| 1,499,894 | A | | 7/1924 | Waterman |
| 1,687,544 | A | | 10/1928 | Clark et al. |
| 1,723,405 | A | | 8/1929 | Carmean |
| 1,813,023 | A | | 7/1931 | Cheslock et al. |
| 2,262,898 | A | | 11/1941 | MacGregor |
| 2,274,935 | A | | 3/1942 | Naul |
| 2,411,782 | A | | 11/1946 | Gardes |
| 2,619,578 | A | | 11/1952 | Jepson et al. |
| 3,087,568 | A | * | 4/1963 | Kurtze ..... 181/290 |
| 3,296,738 | A | | 1/1967 | Wiegel |
| 4,064,427 | A | | 12/1977 | Hansen et al. |
| 4,428,032 | A | | 1/1984 | Workman |
| 4,455,449 | A | | 6/1984 | Rendel |
| 4,504,191 | A | | 3/1985 | Brown |
| 4,508,958 | A | | 4/1985 | Kan et al. |
| 4,531,179 | A | * | 7/1985 | Baker ..... 362/371 |
| 4,626,970 | A | * | 12/1986 | Huang ..... 362/147 |
| 4,657,485 | A | | 4/1987 | Hartwig |
| 4,782,213 | A | | 11/1988 | Teal |
| 5,056,287 | A | * | 10/1991 | Weber ..... 52/511 |
| 5,077,825 | A | | 12/1991 | Monrose |

(Continued)

*Primary Examiner* — Sharon Payne

(74) *Attorney, Agent, or Firm* — Pitts & Lake, P.C.

(57) ABSTRACT

A lighting fixture for use in applications subject to vibrations, such as ceiling fans, the lighting fixture including a socket to accommodate a light bulb, a fixture body to accommodate the socket and house an electrical connection provided to the socket, and a vibration damping member provided between the fixture body and socket to absorb at least a portion of vibrations transferred from the fixture body.

16 Claims, 16 Drawing Sheets

(56) References Cited

U.S. PATENT DOCUMENTS

| | | | | |
|---|---|---|---|---|
| 5,224,830 | A | 7/1993 | Wang | |
| 5,292,228 | A | 3/1994 | Dye | |
| 5,333,235 | A | 7/1994 | Ryder | |
| 5,349,513 | A | 9/1994 | Taylor, III | |
| 5,404,284 | A | 4/1995 | Davis, Jr. | |
| 5,421,701 | A * | 6/1995 | Funston | 416/5 |
| 5,440,459 | A | 8/1995 | Chan | |
| 5,454,692 | A | 10/1995 | Davis | |
| 5,528,469 | A | 6/1996 | Todd, Jr. | |
| 5,545,009 | A | 8/1996 | Ke | |
| D381,074 | S | 7/1997 | Pelonis | |
| 5,668,920 | A | 9/1997 | Pelonis | |
| 5,672,002 | A | 9/1997 | Todd, Jr. | |
| 5,687,068 | A | 11/1997 | Jamieson et al. | |
| 5,800,049 | A | 9/1998 | Todd, Jr. | |
| 5,847,636 | A | 12/1998 | Sehlhorst | |
| 5,877,670 | A | 3/1999 | Sehlhorst et al. | |
| 6,019,577 | A | 2/2000 | Dye | |
| 6,062,816 | A | 5/2000 | Chang | |
| 6,086,226 | A | 7/2000 | Chang | |
| 6,089,725 | A | 7/2000 | Chen | |
| 6,160,956 | A | 12/2000 | Pelonis | |
| 6,213,617 | B1 | 4/2001 | Barker | |
| 6,224,226 | B1 | 5/2001 | Bucher et al. | |
| 6,240,247 | B1 | 5/2001 | Reiker | |
| 6,244,820 | B1 | 6/2001 | Yilmaz | |
| 6,322,232 | B1 | 11/2001 | Oliver | |
| 6,366,733 | B1 | 4/2002 | Reiker | |
| 6,438,322 | B1 | 8/2002 | Reiker | |
| 6,565,237 | B2 * | 5/2003 | Leung | 362/369 |
| 6,631,243 | B2 | 10/2003 | Reiker | |
| 6,676,375 | B2 | 1/2004 | Steeves LeBlanc et al. | |
| 6,682,303 | B2 | 1/2004 | Wu | |
| 6,751,406 | B2 | 6/2004 | Reiker | |
| 6,979,230 | B2 * | 12/2005 | Cherian | 439/662 |
| 7,318,701 | B2 | 1/2008 | Farmer | |
| 8,107,797 | B2 | 1/2012 | Abodreham et al. | |
| 2002/0021891 | A1 | 2/2002 | Reiker | |
| 2002/0064380 | A1 | 5/2002 | Reiker | |
| 2002/0081107 | A1 | 6/2002 | Reiker | |
| 2003/0223869 | A1 | 12/2003 | Wu | |
| 2003/0228142 | A1 | 12/2003 | Reiker | |
| 2004/0247440 | A1 | 12/2004 | Boubin | |
| 2006/0078460 | A1 | 4/2006 | Ryu et al. | |
| 2006/0209532 | A1 | 9/2006 | Hardgrave | |
| 2006/0285310 | A1 | 12/2006 | Shyu | |
| 2010/0316495 | A1 | 12/2010 | Todd, Jr. | |

* cited by examiner

LIGHTING FIXTURE FOR CEILING FAN

CROSS-REFERENCE TO RELATED APPLICATIONS

This application is a Continuation-In-Part of U.S. application Ser. No. 12/862,417, filed Aug. 24, 2010, which is a Continuation-In-Part of U.S. application Ser. No. 11/935,855, filed Nov. 6, 2007.

STATEMENT REGARDING FEDERALLY-SPONSORED RESEARCH OR DEVELOPMENT

Not Applicable

BACKGROUND OF THE INVENTION

1. Field of Invention

The present invention relates to ceiling fans. More particularly, this invention relates to an external assembly for a ceiling fan.

2. Description of the Related Art

Typically ceiling fans have been used to circulate air within a warm environment. For a given environment, it is well known that warmer air generally occupies the area adjacent to the top of the environment and the cooler air generally occupies the area adjacent to the bottom of the environment. The air circulated by the ceiling fan essentially distributes the warmer air and cooler air within the environment such that a person experiences a cooling effect due to the air movement. Thus, typical ceiling fans only circulate air within the environment to create a cooling effect.

Accordingly, use of ceiling fans is generally limited to warm environments because they do not alter the temperature of the air being circulated. Cold environments are an exemplary example where ceiling fans are largely ineffective due to the cooling effect caused by the circulation of air within the environment.

BRIEF SUMMARY OF THE INVENTION

A lighting and heating assembly for a ceiling fan is described in herein and illustrated in the accompanying figures. The lighting and heating assembly is configured for use with an existing ceiling fan that is mounted to a ceiling and includes a plurality of rotatable fan blades, which circulate air within an environment. The ceiling fan also includes an attachment interface and an electrical connection for securing and providing external assemblies.

The lighting and heating assembly includes two main components, namely a lighting assembly and a heating assembly. The lighting and heating assembly includes a lighting assembly for distributing light and a heating assembly for providing heat to the air circulated by the ceiling fan. The lighting assembly is attachable to the ceiling fan and the heating assembly detachably connected to the lighting assembly, which allows the lighting assembly to be used without the heating assembly.

Additionally, the lighting and heating assembly is adjustable such that the lighting assembly and/or heating assembly are repositionable at desired locations in relation to one another and the air flow generated by the ceiling fan. Specifically, the lighting assembly includes a plurality of telescoping arms that extend outwardly and carry a socket in electrical communication with the electrical connection such that a light bulb provides adjustable lighting for an environment.

The heating assembly includes a heating element supported by a thermally isolated heating element cage that provides protection from thermal injuries typically received from contact with an energized heating element.

Furthermore, the lighting and heating assembly provides a plurality of light bulb shields. Generally, the light bulb shields are aesthetically pleasing and are arranged such that unsightly low wattage light bulbs are removed from significant view. Alternatively, the light bulb shields may be configured to provide protection for the light bulbs such that the light bulb is not affected by heat generated by the heating assembly.

Additionally, a lighting fixture for use in applications subject to vibrations, such as those produced in ceiling fans, is provided to improve the operation of an anion bulb.

Various aspects of the present general inventive concept may be achieved by a lighting assembly for a ceiling fan, the ceiling fan having an attachment interface having an electrical connection for powering an external assembly, the lighting assembly including a housing configured to be connected to and supported by the attachment interface of the ceiling fan, an auxiliary connection to provide power to an external device coupled to the housing, and a plurality of lighting arms extending from the housing and respectively provided with a fixture body, a socket to receive a light bulb, the socket being configured to be in electrical communication with the electrical connection of the ceiling fan, and a vibration damping member provided between the fixture body and socket.

The vibration damping member may be fixed to the fixture body and/or the socket.

The vibration damping member may be formed of an elastic polymer, foam material, visco-elastic material, or any combination thereof.

The foam material may include polystyrene foam and/or foam rubber.

A power connection may pass from the socket and through the vibration damping member to the electrical connection of the attachment interface.

The fixture body may be oriented such that a bulb provided to the socket is maintained at a vertical position.

The vibration damping member may be an air and/or liquid filled membrane.

The vibration damping member may be segmented to regulate distribution of the air and/or liquid provided within the membrane.

The vibration damping member may be coated on the fixture body and/or the socket such that rigid portions of the fixture body and socket do not contact one another.

The vibration damping member may support at least portions of a bottom surface and/or side surface of the socket.

A first vibration damping material may support the at least a portion of the bottom surface of the socket, and a second vibration material supports the at least a portion of the side surface of the socket.

At least a portion of the vibration damping member may be formed of a material to support decorative attachments while absorbing at least a portion of vibrations transferred from the ceiling fan.

The lighting assembly may further include decorative members that are readily attachable and detachable to the vibration damping member.

Various aspects of the present general inventive concept may also be achieved by a lighting fixture including a socket to accommodate a light bulb, a fixture body to accommodate the socket and house an electrical connection provided to the socket, and a vibration damping member provided between the fixture body and socket to absorb at least a portion of vibrations transferred from the fixture body.

The lighting fixture may be formed such that rigid portions of the fixture body do not contact rigid portions of the socket.

Various aspects of the present general inventive concept may also be achieved by a lighting assembly for a ceiling fan, the ceiling fan having an attachment interface having an electrical connection for powering an external assembly, the lighting assembly including a housing configured to be connected to and supported by the attachment interface of the ceiling fan, an auxiliary connection to provide power to an external device coupled to the housing, a lighting fixture body coupled to the housing, and a vibration damping member provided between the fixture body and the housing to absorb at least a portion of vibrations transferred from the ceiling fan.

The lighting fixture body may be suspended from housing by the vibration damping member.

The lighting fixture body may be a lantern type fixture.

The lighting fixture body may be suspended by a hook connection that is coated with a vibration damping material or combination of vibration damping materials.

Other features and aspects may be apparent from the following detailed description, the drawings, and the claims.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

A lighting and heating assembly for a ceiling fan is described in detail herein and illustrated in the accompanying figures. The lighting and heating assembly is configured for mounting to an existing ceiling fan. The lighting and heating assembly includes a lighting assembly for distributing light and a heating assembly for providing heat to the air circulated by the ceiling fan. The lighting assembly is configured to attach to the ceiling fan and has the heating assembly detachably connected thereto, which allows the lighting assembly to be used without the heating assembly. Additionally, the lighting and heating assembly is adjustable such that the lighting assembly and/or heating assembly are repositionable at desired locations in relation to one another and the air flow generated by the ceiling fan.

Figure 1:
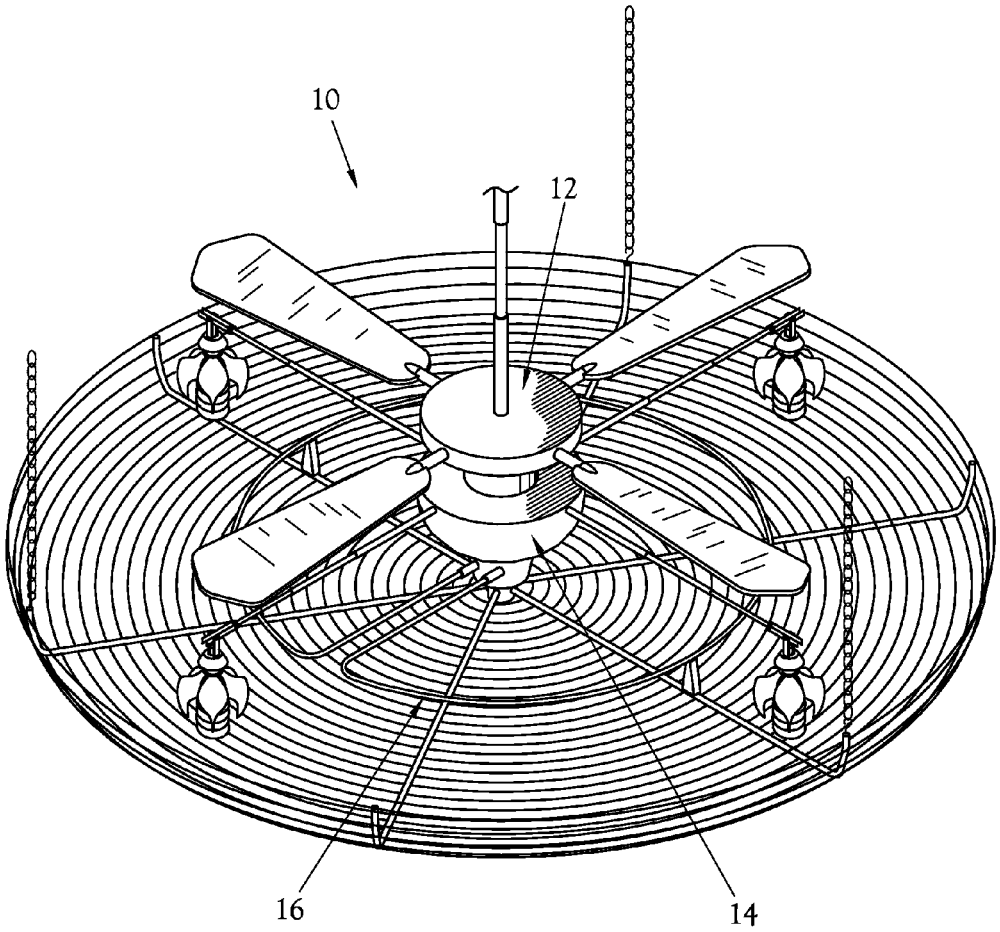
FIG. 1 is a perspective view of one embodiment of the present invention.

FIG. 1 illustrates one embodiment of a lighting and heating assembly 10 for a ceiling fan 12. As illustrated, the lighting and heating assembly 10 is attachable to the ceiling fan 12 and includes two main components, namely a lighting assembly 14 and a heating assembly 16.

Figure 2:
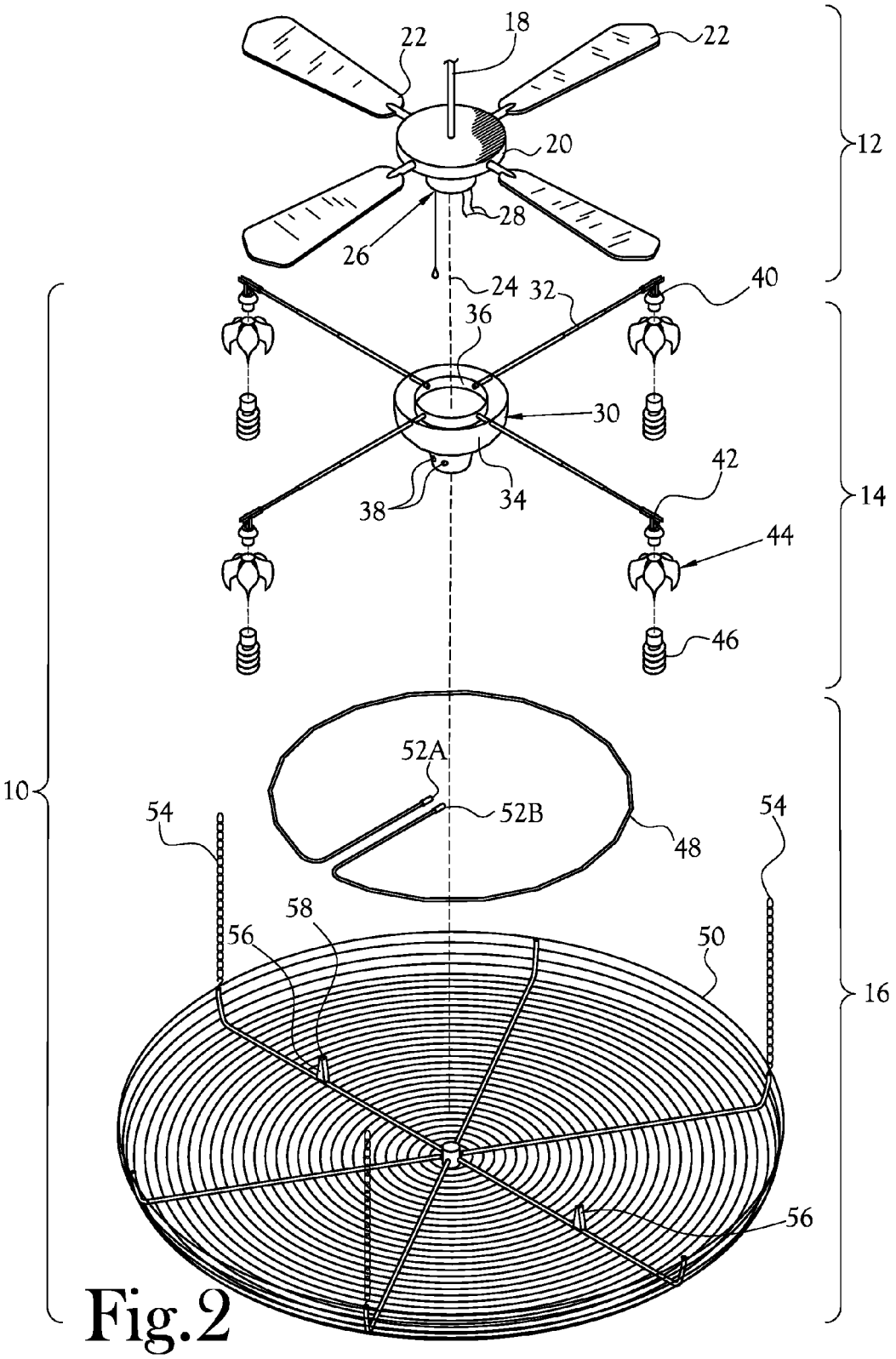
FIG. 2 is an exploded view of the embodiment of the present invention depicted in FIG. 1.

FIG. 2 illustrates an exploded view of the embodiment of the lighting and heating assembly 10 and the ceiling fan 12 depicted in FIG. 1. The lighting and heating assembly 10 is attachable to a ceiling fan 12, which is mounted to a ceiling, or other structural support, and provides circulation for an environment. In the depicted embodiment, the ceiling fan 12 is suspended by tubing 18, such as a downrod, that allows the ceiling fan 12 to be mounted to variable height structures, e.g., standard and lofted ceilings. The tubing 18 also provides a conduit through which wiring extends from the ceiling to the ceiling fan 12 for providing power. The ceiling fan 12 includes a fan housing 20 that encloses a conventional fan motor (not shown) having a plurality of fan blades 22. The fan blades 22 being arranged to generate air circulation. For example, in FIG. 2, the fan blades 22 are fabricated of wood, or other suitable material, in an oblong shape, in which two elongated sides are substantially parallel, one end defining a semicircle, and the other end having a decorative curve that forms a point, or shape with dimensions that are effective for creating air circulation. The fan blades 22 extend outward at equally spaced intervals around a vertical axis 24, as depicted in FIG. 2, defined by the ceiling fan 12. A rigid arm mounts the semicircle end of the fan blade 22 to a conventional fan motor at a desired angle such that, upon rotation of the fan blades 22, air is circulated. Furthermore, the bottom of the fan housing 20 provides an attachment interface 26 for securing external assemblies to the ceiling fan 12 and an electrical connection 28 for providing power to an external assembly. The fan housing 20 also provides controls, as depicted by pull-chains in FIG. 2, for the operation of the ceiling fan 12, and any attached external assembly. Alternatively, fan controls may be provided through wall-mounted or radio frequency devices.

The lighting assembly 14, illustrated in FIG. 2, includes a housing 30 and one or more lighting arms 32. The housing 30 is attachable to the ceiling fan 12 and encloses electrical components of the lighting assembly 14. In the illustrated embodiment, the lighting assembly 14 is secured to the attachment interface 26 of the ceiling fan 12 by fasteners, for example bolts. The light assembly housing 30 includes a casing 34, which encloses a frame 36 configured to support a plurality of lighting arms 32. As an example, in the illustrated embodiment, the casing 34 has an inverted bell shape, with a larger diameter at the top that tapers to a smaller diameter at the bottom. The casing 34 is open at the top such that the casing 34 receives a portion of the ceiling fan housing 20 when attached to the ceiling fan 12. Additionally, the lighting assembly housing 30 further includes an auxiliary connection 38 for attachment of the heating assembly 16 wherein the auxiliary connection 38 is in electrical communication with the electrical connection 38 provided by the ceiling fan 12.

The plurality of lighting arms 32 provides rigid support for the lighting. Generally, each of the lighting arms 32 is hollow such that electrical components are hidden. In FIG. 2, the plurality of lighting arms 32 are each fabricated from long, hollow, and cylindrically shaped tubing. Furthermore, in the illustrated embodiment, the lighting arms 32 are telescoping for allowing a desired amount of outward extension from the casing 34. For example, the length of the lighting arms 32 can extend outward farther from the vertical axis 24 than the rest of the lighting and heating assembly 10 such that the distribution of lighting is not effected.

The lighting arms 32 carry a light bulb socket 40 at the outboard end of each lighting arm 36. In one embodiment, a pivotal joint 42 is provided for each lighting arm 32 to allow adjustable orientation of the light bulb socket 40. For example, in the illustrated embodiment, the end of a lighting arm 32 includes a hinged connector for supporting a light bulb socket 40 and allowing the light bulb socket 40 to be pivoted in a desired direction. As depicted, the hinged connector is pivoted into a vertical orientation relative to the ground. In another embodiment, the hinged connector allows the light bulb socket 40 to pivot approximately 180 degrees along a vertical or horizontal axis. The lighting arms 32 carry a light bulb socket at the outboard end of each lighting arm 32 to rotate 360 degrees. FIG. 2 further depicts light bulbs shields 44, which are subsequently discussed in detail, being carried by each light bulb 46.

The lighting assembly 14 is powered by the ceiling fan 12 or other suitable power source. In the illustrated embodiment, the lighting assembly 14 is in electrical communication with the electrical connection 28 of the attachment interface 26 such that a user controls the lighting assembly 14 through the controls for the ceiling fan 12. The power supplied to the electrical connection 28 transfers power through wiring in the lighting arms 32 to the bulb sockets 40. In the illustrated embodiment, the light bulbs 46 secured to the light bulb sockets 40 are controlled by a switch or controller, such as a pull-chain.

The heating assembly 16 is supported by the ceiling fan and, more specifically, detachably mounted to the lighting assembly 14. The heating assembly 16 includes a heating element 48 and a heating element cage 50. The heating element 48 is generally positioned in communication with air flow produced by the ceiling fan 12. In the illustrated embodiments, the heating element 48 is positioned in a substantially horizontal plane, which is approximately parallel to the plane of the fan blades 22, allowing for direct exposure of the heating element 48 to the air flow generated by the ceiling fan 12. The heating assembly 16 is powered by a power supply which provides an effective amount of power for the heating element 48 to produce heat. In the illustrated embodiments, the heating element 48 has two terminals, namely a first terminal 52A and a second terminal 52B, which connect the heating element 48 in electrical communication with the auxiliary connection 38 of the lighting assembly 14. Additionally, the terminals 52A and 52B are readily detachable from the auxiliary connection 38 such that the heating assembly 16 is detachable from the lighting assembly 14.

The heating element cage 50 is permeable to air flow while providing support to the heating element 48 without significantly impeding the flow of air. In FIG. 2, the heating element cage 50 is disposed in a horizontal plane substantially parallel to the heating element 48 such that the heating element cage 50 provides support for the heating element 48 and restricts contact with the heating element 48. More specifically, the depicted heating element cage 50 comprises wire members formed into a configuration that provides large openings for air flow while producing an aesthetically pleasing design. It should also be noted that a large heating element cage 50 may require additional support for attachment to the lighting assembly 14 and ceiling fan 12. For example, in the illustrated embodiment, the heating element cage 50 is detachably connected to the ceiling by chains 54.

Additionally, in the illustrated embodiment, the heating element cage 50 supports the heating element 48 such that the heating element 48 is thermally isolated from the heating element cage 50 for providing protection from thermal injuries received from contact with an energized heating element 48. More specifically, the heating element cage 50 supports the heating element 48, in an elevated relationship to the heating element cage 50, by a plurality of heating element supports 56. The heating element supports 56 are disposed in spaced apart relationship to one another around the perimeter of the heating element 48. These heating element supports 56 are fixed to the cage 50 through welds or other suitable manner. In the illustrated embodiment, the heating element supports 56 are triangular-shaped and are situated with the base secured to the heating element cage 50 and the apex providing support for the heating element 48. More specifically, the depicted heating element supports 56 are ceramic insulators with semicircle indentations 58, which have an interior diameter substantially the same as the outer diameter of the heating element 48, at the apex of the triangle to support and mount the heating element 48 to the heating element cage 50. In alternate embodiments, the heating element supports 56 can be fabricated from another material suitable for insulating the cage 50 from heat produced by the heating element 48.

Figure 3A:
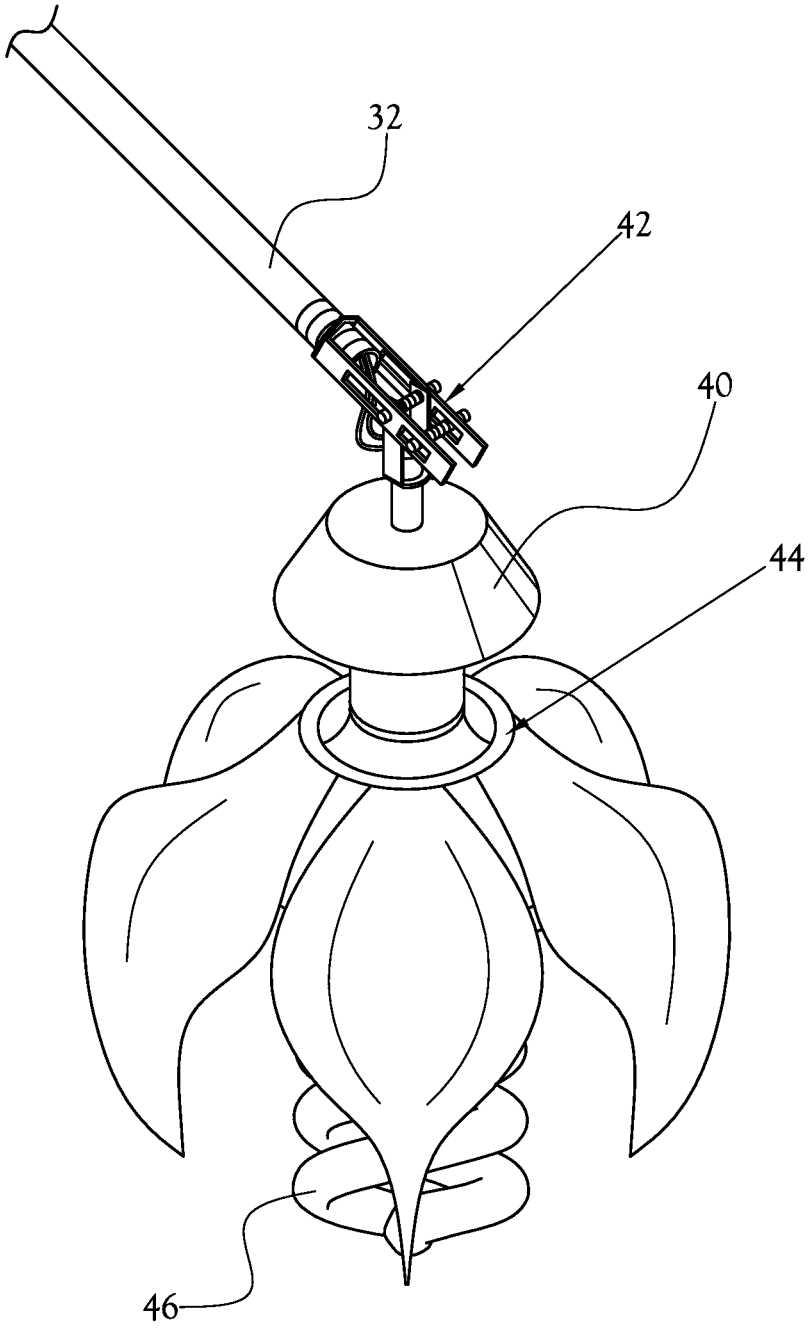
FIG. 3A is an enlargement of one embodiment of a light bulb shield having the front portion of shielding in hidden line to provide clarity of a low energy bulb shielded by the light bulb shield.
Figure 3B:
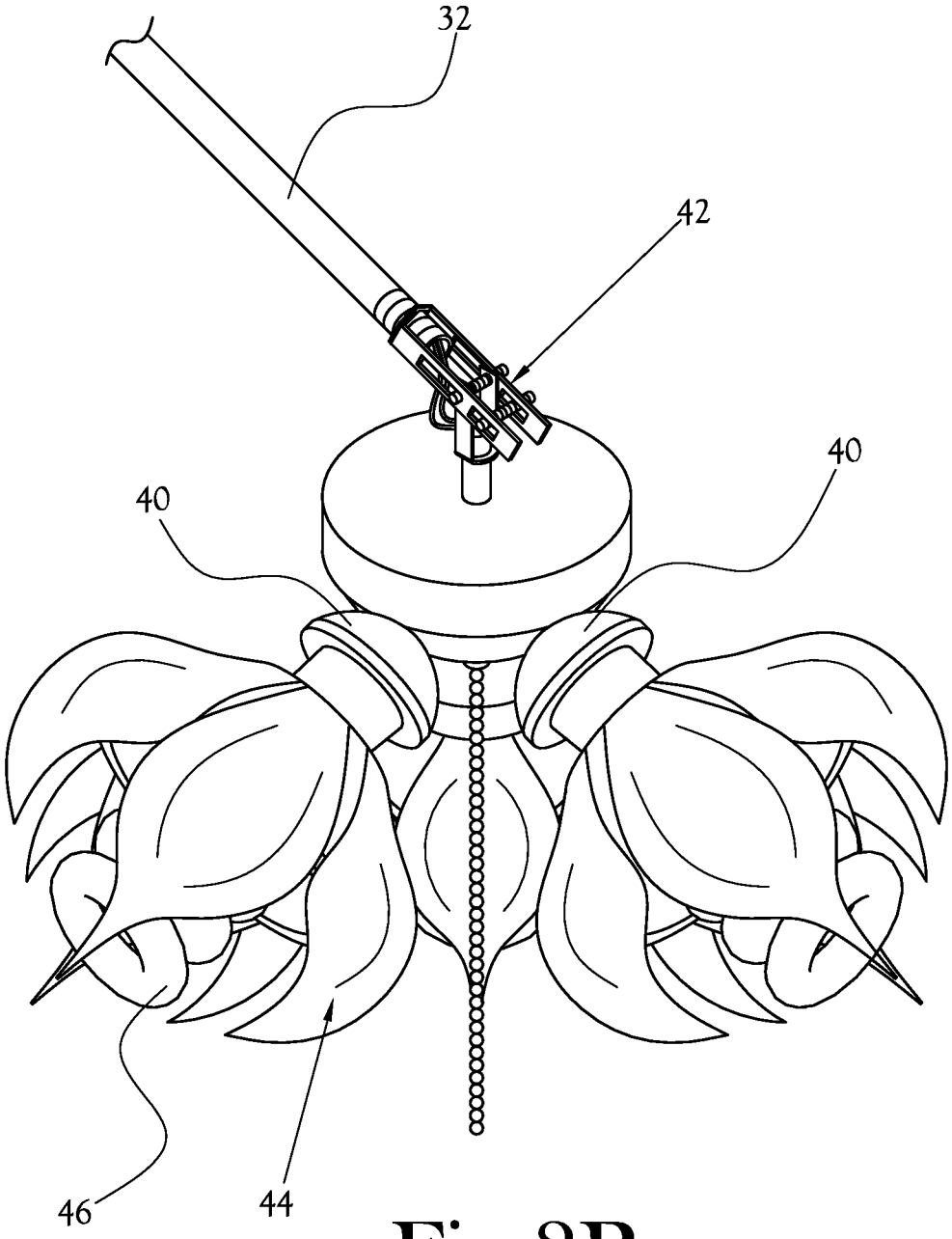
FIG. 3B is one embodiment of a cluster of light bulb shields and low energy bulbs.
Figure 3C:
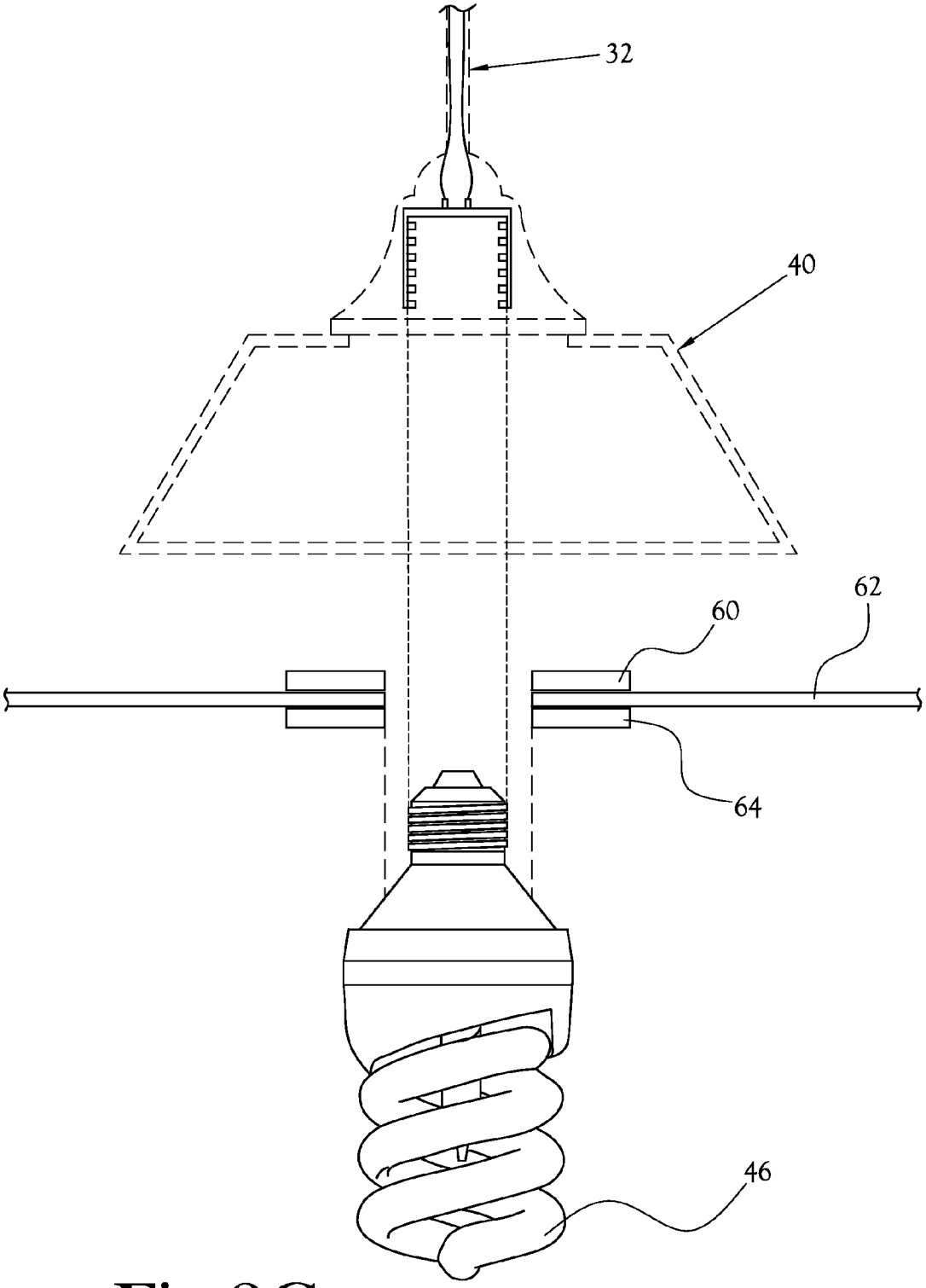
FIG. 3C is a sectional view of one embodiment of a light bulb shield in relation to the light bulb socket and a low energy bulb.

FIGS. 3A, 3B, and 3C illustrate embodiments of the light bulb shields 44 in greater detail. Each light bulb shield 44 is configured to be carried by a light bulb 46 such that at least a portion of the light bulb 46 is concealed. Generally, these light bulb shields 44 are arranged in an aesthetically pleasing design. For example, as shown in FIGS. 3A and 3B, the light bulb shields 44 include an aesthetically pleasing arrangement of leaves removing the unsightly low wattage light bulbs 44 from significant view. Alternatively, the light bulb shields 44 provide protection for the light bulbs 46 such that the light bulb 46 is not affected by heat generated by the heating assembly 16. For example, the light bulb shields 44, for use while utilizing the heating assembly 16, offer increased protection for the light bulbs 46. More specifically, the light bulb shields 44 are fabricated from material which is heat resistant and noncombustible, whereby heat generated by the heating assembly 16 will not affect the performance of the light bulb 46. Additionally, as depicted in FIG. 3B, a cluster of light bulb shields 44 and light bulbs 46 offer increased lighting for an environment.

Generally, these light bulb shields 44 are secured to the light bulbs 46 such that the light bulb shields 44 hang from the light bulbs 46. FIG. 3C illustrates one embodiment of the light bulb 46 and a sectional view of the light bulb shields 44 in relation to the bulb socket 40, depicted in hidden line. The bulb socket 40 is configured to receive the threaded end of a light bulb 46 such that the light bulb 46. More specifically, the light bulb shield 44 defines a central opening through which a narrow portion of the light bulb (e.g., the neck) passes and the wider portion of the light bulb 46 (e.g., the body) is restricted from passing. As a result, the light bulb shield 44 rests on the light bulb 46 when secured to the bulb socket 40. In the illustrated embodiment, the light bulb shield 44 includes an upper ring 60, shielding 62, and a lower ring 64. As depicted, the upper ring 60 and lower ring 64 cooperate together to receive and secure shielding 62 there between, for example in one embodiment the shielding 62 is glued to upper ring 60 and lower ring 64. In alternate embodiments, the light bulb shield 44 includes, but is not limited to, a single ring, a decorative ring, covering for the rings, or forming a ring with the shielding 62.

Figure 4A:
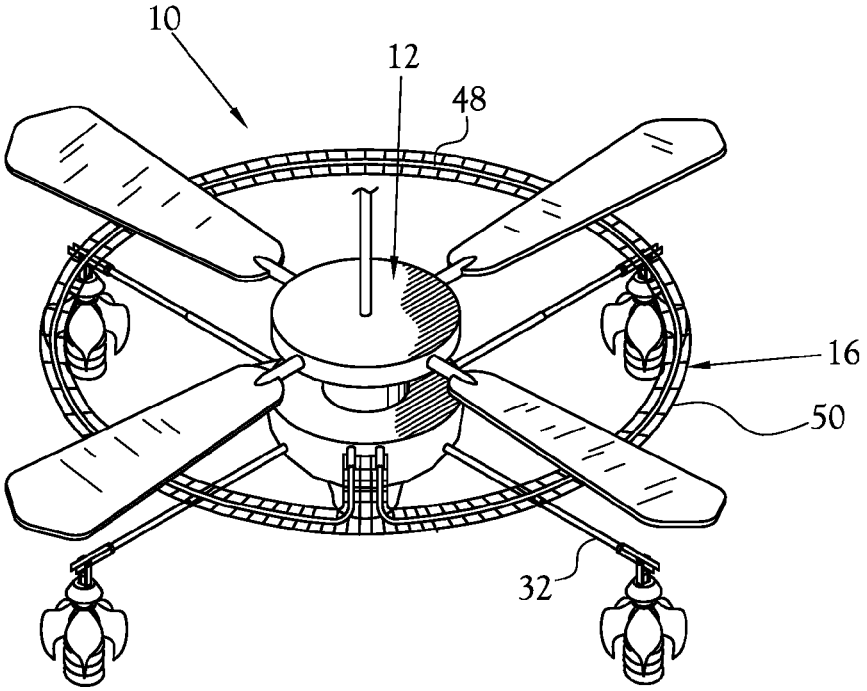
FIG. 4A is a perspective view of one embodiment of the present invention wherein the heating assembly is repositioned above the lighting assembly.
Figure 4B:
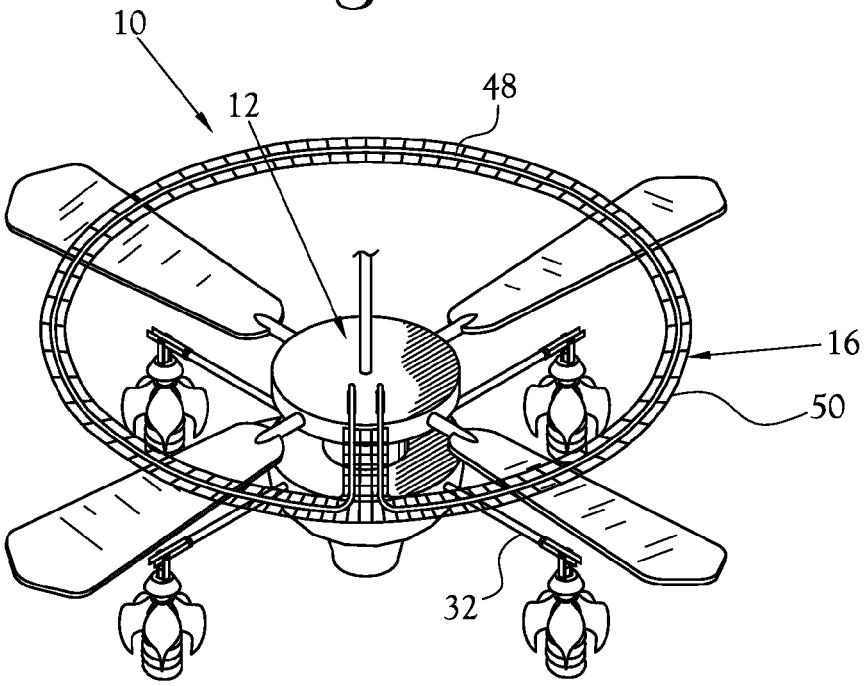
FIG. 4B is a perspective view of one embodiment of the present invention wherein the heating assembly is repositioned above the ceiling fan.

FIGS. 4A and 4B show alternate embodiments of the lighting and heating assembly for a ceiling fan 10 having an adjustable heating assembly 16, which allows the heating element 48 and heating element cage 50 to be repositioned relative to the air flow generated by the ceiling fan 12. It will be appreciated that the adjustable arrangements of the heating assembly 16 allow a user to selectively control the manner of lighting and heating for an environment. For example, the lighting arms 32 extend outward two lengths of tubing in FIG. 4A, but only one length of tubing in FIG. 4B.

In the embodiment illustrated in FIG. 4A, the heating assembly 16 is configured to provide sufficient heating for a selected area of the environment, which is essentially the area below the ceiling fan 12, while providing insufficient heating for the entire environment. More specifically, air directed downwards comes in contact with the heating element 48 such that the downward air flow is heated and thereby heating the isolated area below the heating assembly 16. For example, in a large environment, warm air near the top of the environment is directed downward into communication with the heating element, whereby the air is heated and directed into the localized area below the heating element such that a first person standing below the heating assembly 16 experiences a warmer temperature than a person standing away from the heating assembly 16. In this arrangement, the heating assembly 16 provides heat to an occupied area of an environment while eliminating the need to heat the entire environment.

Alternatively, in the embodiment illustrated in FIG. 4B, the heating assembly 16 is positioned above the ceiling fan 12 and the lighting assembly 14 such that the heating element 48 is positioned in communication with upward air flow produced by the ceiling fan 12. More specifically, air directed upwards comes in contact with the heating element 48 such that the air is heated and thereafter directed towards the perimeter of the environment and circulated within the environment. For example, in an environment such as a room, cool air in the environment is slowly directed upwards into communication with the heating element 48 such that the air is heated and directed towards the perimeter the environment and thereafter circulated into the environment. In this arrangement, the heating assembly 16 is responsible for providing heated air throughout the entire environment, such as a single room in a house, without requiring the heating of air in other environments, such as other rooms within a house. Accordingly, it is recognized that the adjustable arrangements of the heating assembly 16 allow a user to selectively control whether to provide heat for a small portion of an environment or the entire environment without heating neighboring environments thereby providing energy efficient heating for the user.

Figure 5A:
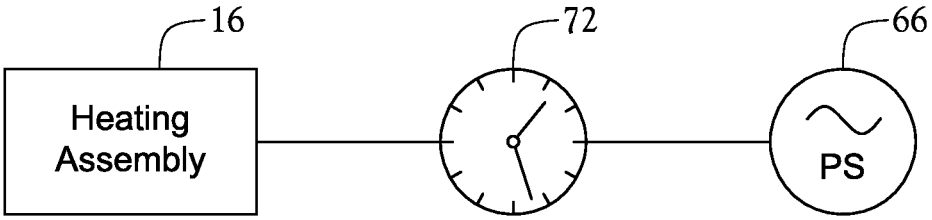
FIG. 5A illustrates a diagram of the power supply and a timer as represented by one embodiment of the present invention.
Figure 5B:
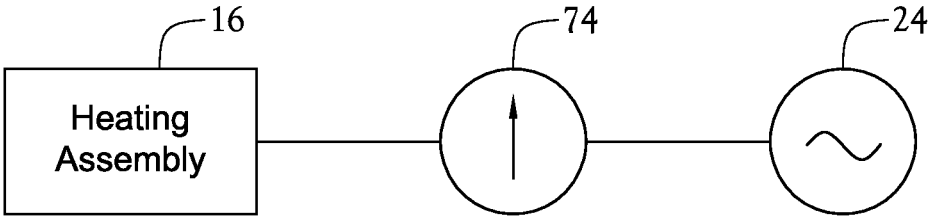
FIG. 5B illustrates a diagram of the power supply and a rheostat as represented by one embodiment of the present invention.
Figure 5C:
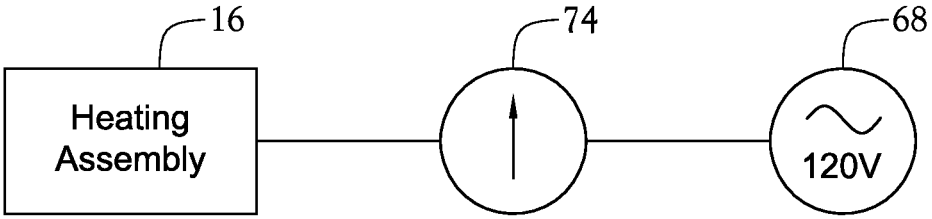
FIG. 5C illustrates a diagram of the power supply and a rheostat as represented by one embodiment of the present invention.
Figure 5D:
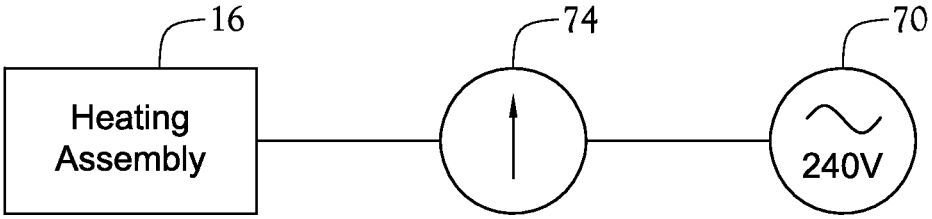
FIG. 5D illustrates a diagram of the power supply and a rheostat as represented by one embodiment of the present invention.
Figure 5E:
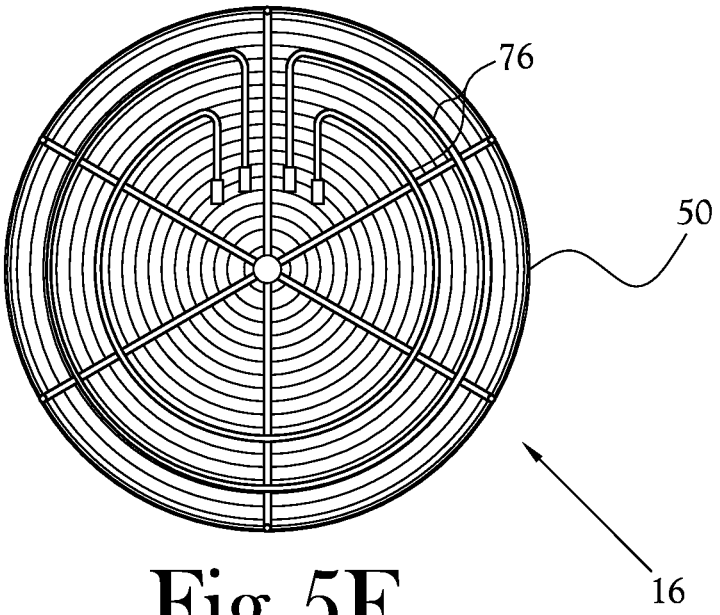
FIG. 5E is a perspective view of one embodiment of the heating element.
Figure 5F:
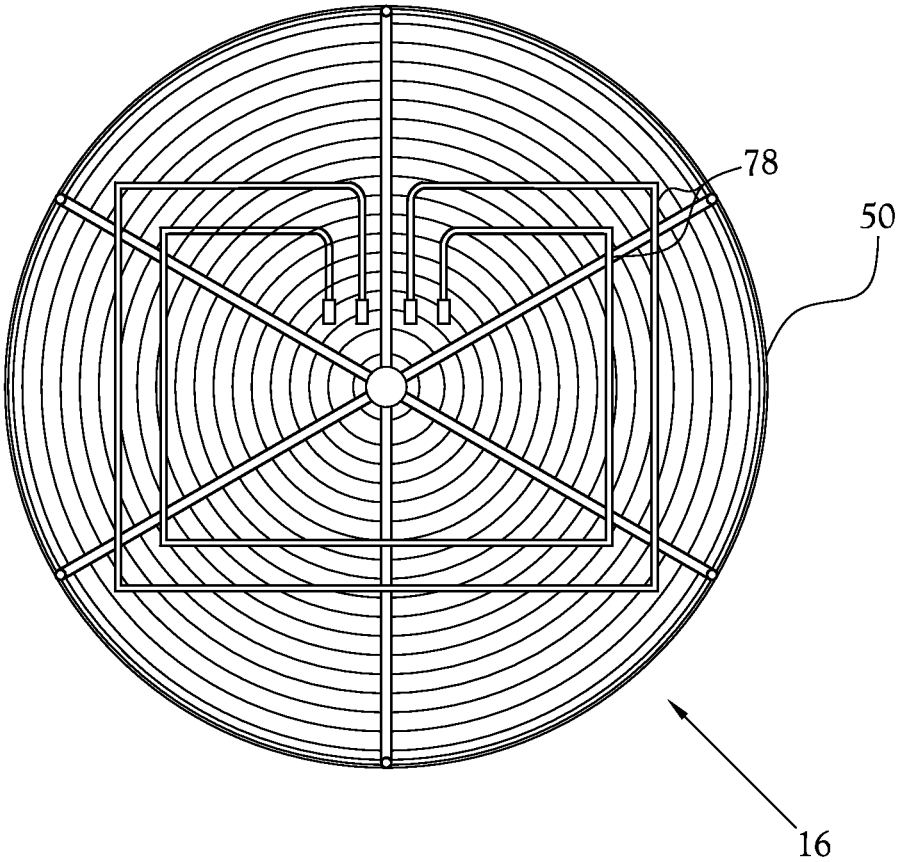
FIG. 5F is a perspective view of one embodiment of the heating element.

FIGS. 5A-5G illustrate diagrams wherein the heating element is configured to provide variable levels of heating for the environment. Variable levels of heating for the environment are determinable by user controls, altering the surface area of the heating element, arrangement of the heating element, or the like. For example, as illustrated in FIGS. 5A-D, power may be provided by any power source 66 (FIG. 5A), the electrical connection 24 (FIG. 5B) provided by the ceiling fan 12, an independent 120 volt power supply 68 (FIG. 5C), or an independent 240 volt power supply 70 (FIG. 5D). Furthermore, as depicted in FIG. 5A, the controls for the heating assembly 16 include a time control 72 to automatically turn on or off the heating assembly 16. Alternatively, as illustrated by FIGS. 5B-D, placing a rheostat 74 further allows a user to adjust the power supplied to the heating assembly 16 to increase or decrease the temperature at which the heating assembly 16 operates. Inclusion of any of the above controls further increase the energy efficiency of the heating assembly 16 and decreased the cost and saves money for heating an area.

Figure 5G:
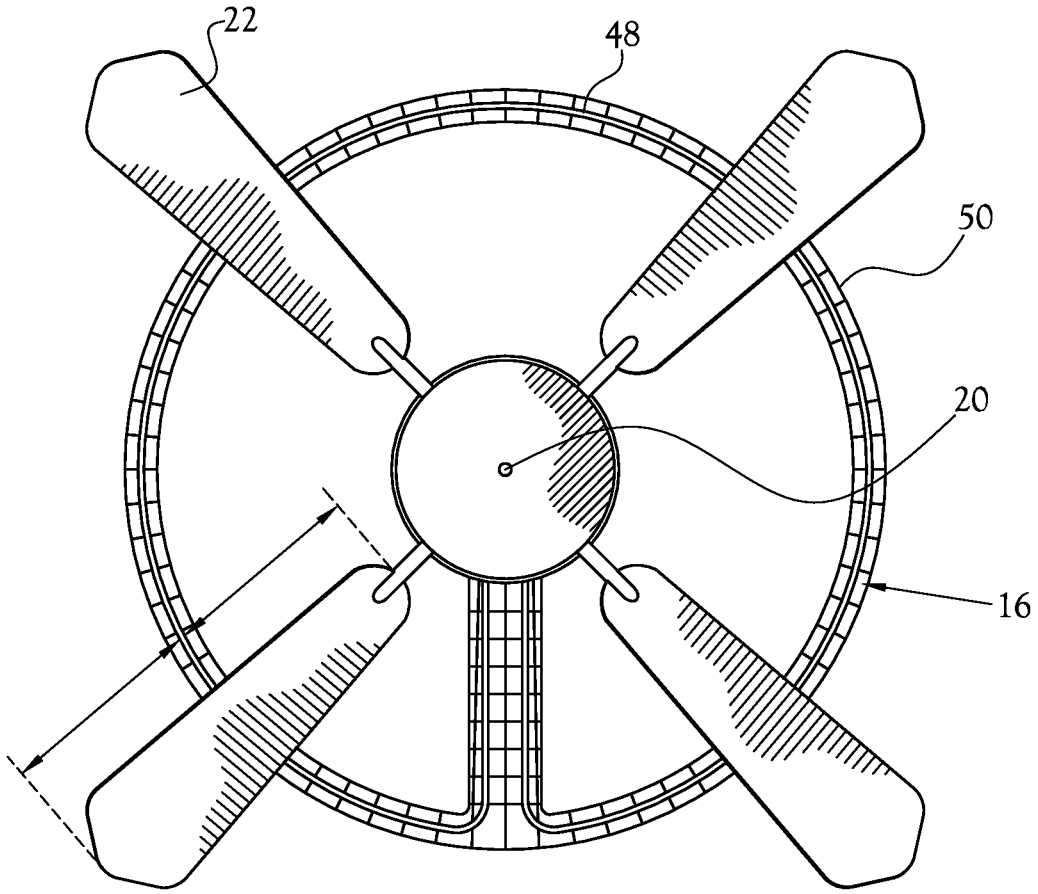
FIG. 5G is a plan view of one embodiment of the ceiling fan and the lighting and heating assembly of the present invention, showing the area in the plane which the heating assembly may occupy.

Alternatively, the heating characteristics of the heating assembly 16 are adjustable by varying the shape and number of the heating element 48. For example, the surface area of the heating element 48 is increased by including a series of concentric circles 76 each having a smaller radius than the previous, or a series of rectangles 78 in which each rectangle has a smaller rectangle within the interior. Lastly, the exposure of the heating element 48 is maximized by positioning the heating element 48 to extend outwardly from the vertical axis 20 a distance of about half the length of the individual lengths of the fan blades 18. As illustrated in FIG. 5G, the heating element 48 is positioned around the vertical axis 20 at distances between the inside edge and outside edge of the fan blades 18 such that the position of the heating element 48 is in the direct air flow generated by ceiling fan 12.

Figure 6:
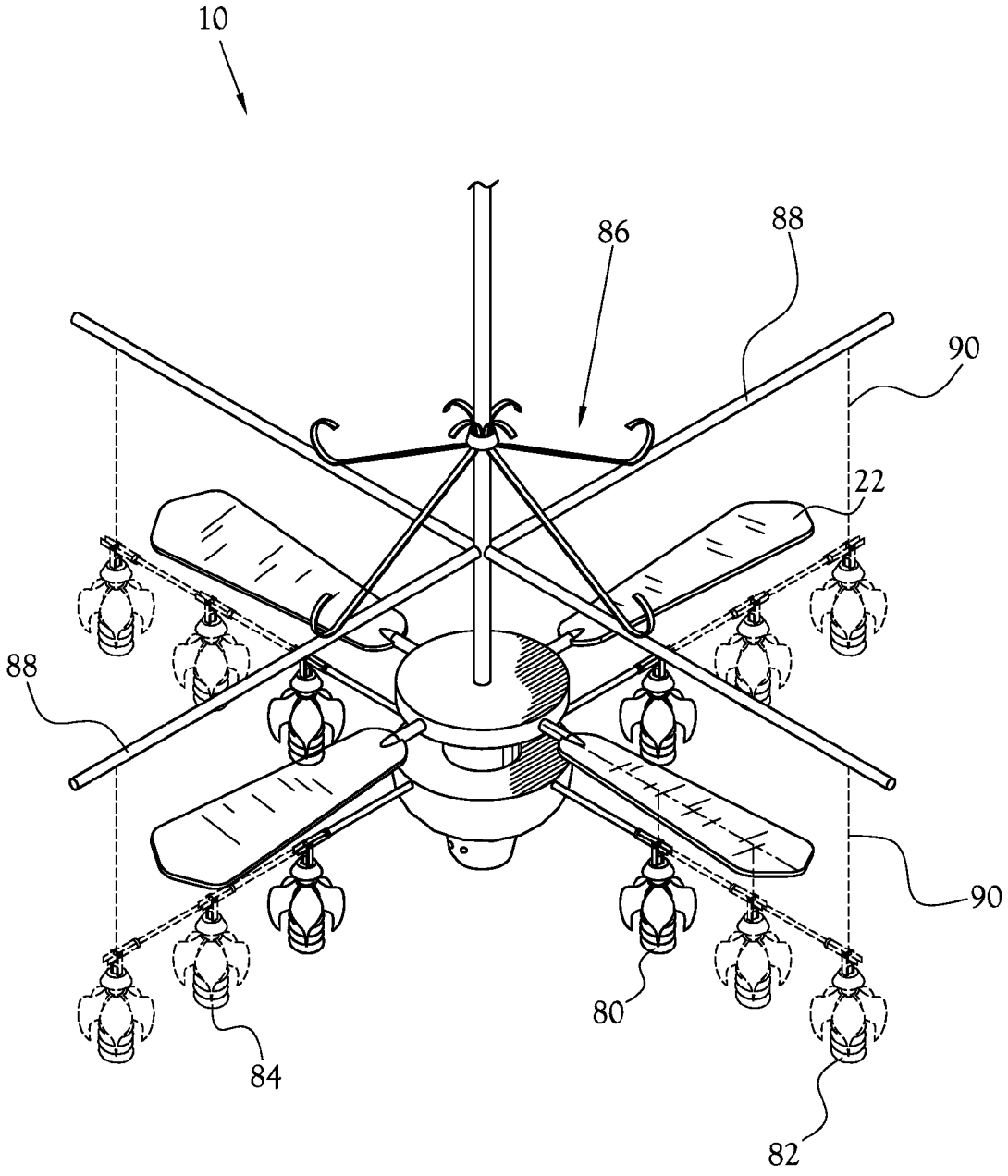
FIG. 6 is a perspective view of one embodiment of the present invention including telescoping lighting arms and showing the available support provided by the upper support.

FIG. 6 illustrates a ceiling having one embodiment of the lighting and heating assembly 10 secured thereto is provided. As depicted, the lighting and heating assembly 10 has the heating assembly 16 detached from the lighting assembly 14 such that the ceiling fan 12 only supports the lighting assembly 14. This functionality allows a user to selectively utilize the lighting and heating assembly 10 such that the user enjoys the benefits of the lighting assembly 14 without the heating assembly 16. In the embodiment illustrated in FIG. 6, the lighting assembly 14 includes telescoping lighting arms 36 configured to extend the socket 40 between a first location 80 and a second location 82, namely a location proximate the housing 30 and position remote from the housing 30, respectively. In the first position 80 the lighting arms 36 support the light bulbs 46 in a relatively small radius about the vertical line 20 such that lighting is generally directed to the area below lighting and heating assembly 10. This arrangement provides a greater concentration of light for performing activities, such as reading. Moreover, in the first position 80, the lighting assembly 14 positions the light bulbs 46 at a position of direct air flow generated by ceiling fan 12 between the inside edge and outside edge of the fan blades 18. Additionally, this placement is ideal for ionizers, such as anion bulbs, for maximum exposure of air flow generated by the ceiling fan 12 and thereby providing the maximum amount of purification. In the second position 82, the lighting arms 36 support the light bulbs at a larger radius from the vertical line 20 such that lighting is directed into a larger portion of the environment, or even the entire environment, thereby reducing the necessity of using additional lighting throughout the environment. Alternatively, the user can position the lighting arms 36 between the first position 80 and second position 82, such as the interim position 84, which provides lighting as desired.

In one embodiment, the lighting and heating assembly 10 includes additional support for reducing deflection of the lighting arms 32 when fully extended. For example, in FIG. 6, the lighting and heating assembly 10 includes an upper support 86. The upper support 86 is attached to the tubing 14 for the ceiling fan 12 and includes members 88 that extend outward from the tubing 14 to a position in register with the lighting arms 36. More specifically, the distal end of a lighting arm 36 is connected to a distal end of members 88 of the upper support 86 by a readily attachable and detachable cable 90, which allows the upper support 86 to be selectively utilized in supporting the lighting assembly 14. In alternate embodiments, the members 88 are securable to the ceiling by the cable 90.

Regarding the use of ionizers such as the anion bulbs discussed above, it has been shown that vibrations in lighting applications including anion bulbs may result in a negative impact on the performance of those bulbs. The rotation of the blades of a ceiling fan may cause such vibrations that can cause the anion bulbs to lose at least some of their effectiveness. Therefore, various example embodiments of the present general inventive concept provide a lighting fixture with a vibration damping member to attenuate the vibrations transferred to the anion bulb.

Figure 7:
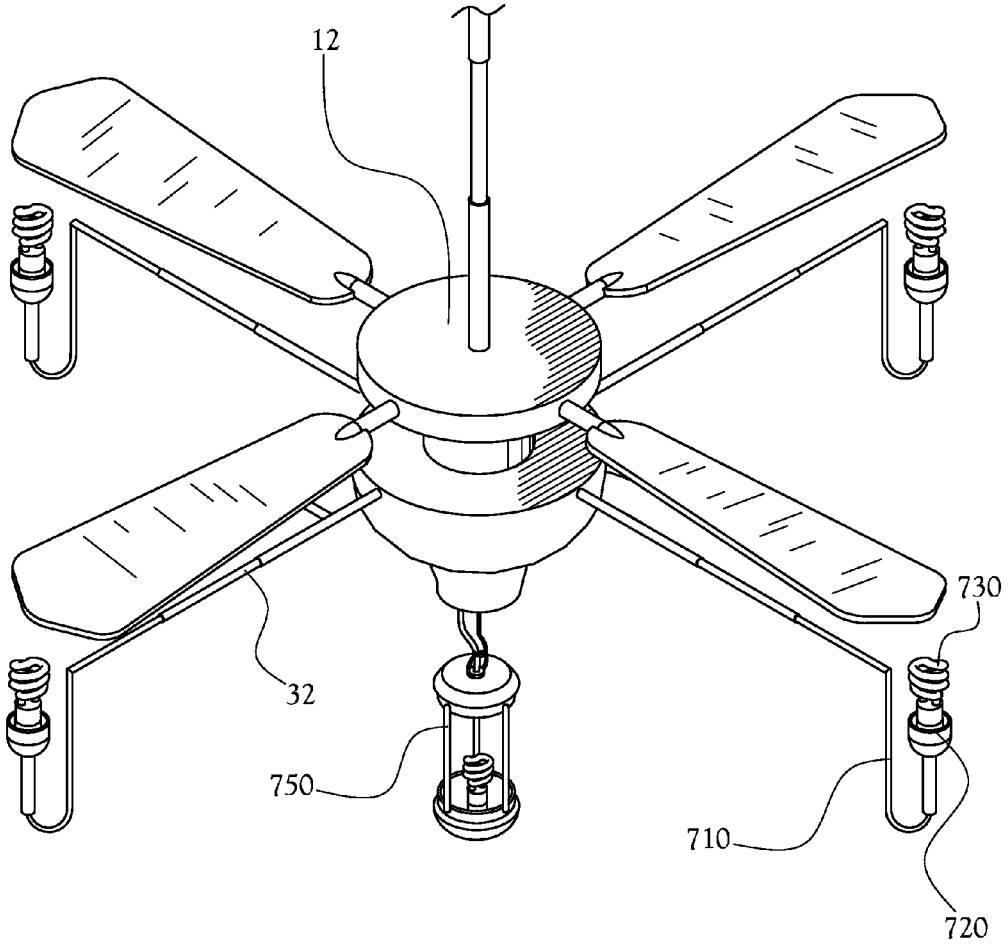
FIG. 7 illustrates an example embodiment of the present general inventive concept in which a vibration damping member is provided to the lighting fixtures of the lighting assembly.

FIG. 7 illustrates an example embodiment of the present general inventive concept in which a vibration damping member is provided to the lighting fixtures of the lighting assembly. In FIG. 7 the lighting assembly 14 of the ceiling fan 12 is provided with lighting fixture bodies 710, at the distal ends of the lighting arms 32, which include the vibration damping member provided between the socket 720 and the anion bulb 730. The vibration damping member, which will be described in more detail in the following drawings, absorbs at least some of the vibrations that would otherwise be transferred from the lighting fixture bodies 710 to the socket 720, and therefore to the anion bulb 730, due to the vibrations generated by the operation of the ceiling fan 12. It is noted that the previous discussion of FIGS. 2-3 described the socket 40 generally as being the portion of the lighting assembly 14 at the end of the lighting arms 32 that received the light bulb 46. However, in the descriptions of FIGS. 7-13, the socket 720 is more specifically referred to as the portion of the lighting assembly 14 to which the anion bulb 730 is directly installed, and which is in electrical communication with the lighting assembly 14. In conventional lighting applications, the socket is typically fixed directly to the lighting fixture body which accommodates it, with rigid portions of the socket and lighting fixture body in direct contact. In various example embodiments of the present general inventive concept, the vibration damping member prevents such contact, such as metal on metal contact, between the lighting fixture bodies 710 and the socket 720. Also, as illustrated in FIG. 7, various example embodiments of the present general inventive concept provide the lighting fixture bodies 710 in an upright vertical position, which may be a more effective orientation for the operation of the anion bulbs 730.

Figure 8:
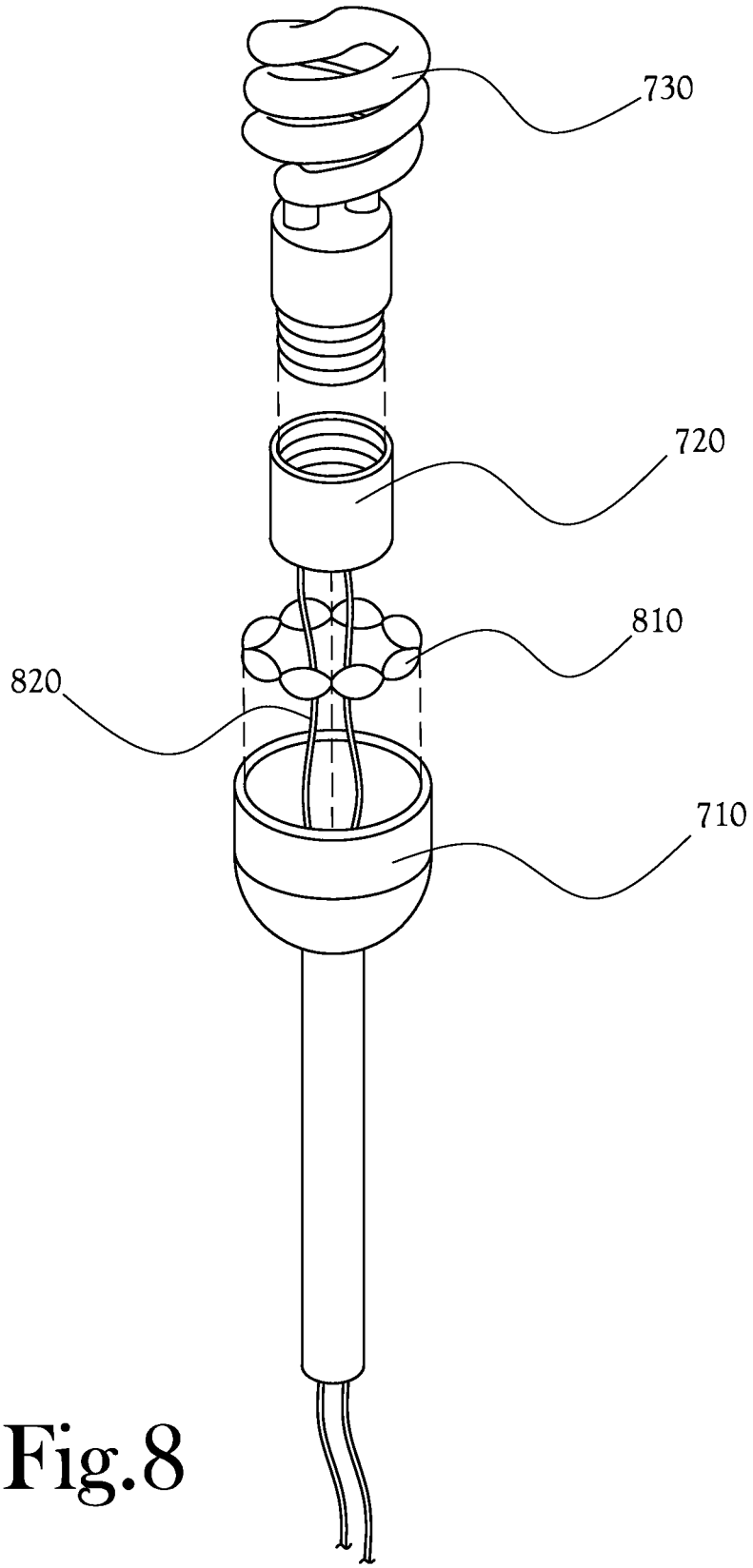
FIG. 8 illustrates an exploded view of a portion of the lighting assembly illustrated in FIG. 7.

FIG. 8 illustrates an exploded view of a portion of the lighting assembly illustrated in FIG. 7. In FIG. 8, the vibration damping member 810 is provided between the socket 720 and the lighting fixture body 710 such that the socket 720 is not in direct contact with the lighting fixture body 710. Rather, the socket 720 rests upon the vibration damping member 810, and as such does not receive at least some of the vibrations which would otherwise be transferred to the socket 720 from the lighting fixture body 710 due to the operation of the ceiling fan 12. The vibration damping member 810 may be affixed to either or both of the lighting fixture body 710 and the socket 720, or may rest between the lighting fixture body 710 and socket 720, to provide the vibration damping between the lighting fixture body 710 and the socket 720. For instance, various example embodiments may provide the vibration damping member 810 affixed to the socket 720 as a vibration damping coating that approximates the outer shape of the socket 720, as long as the otherwise rigid portion of the socket 720 does not contact the corresponding rigid portion of the lighting fixture body 710.

The vibration damping member 810 may be formed of any of a number of materials, or as a composite of different materials. According to various example embodiments, the vibration damping member 810 may be formed of, for example, one or more elastic polymers such as rubber or silicone, one or more visco-elastic materials, one or more foams such as polystyrene or foam rubber, or similar vibration damping materials, or combinations of such materials. The vibration damping member 810 may be of a solid construction, or may be a type of membrane surrounding air or a fluid or gaseous substance. Additionally, the vibration damping member 810 may have a continuous or segmented structure. In the example embodiment illustrated in FIG. 8, the vibration damping member 810 is a segmented and air-filled rubber membrane. However, as previously described, this is merely an example material and construction for a vibration damping member 810 according to the present general inventive concept.

As illustrated in FIG. 8, the socket 720 is prevented from making direct contact with the lighting fixture body 710 due to the presence of the vibration damping member 810. The anion bulb 730 is accommodated in the socket 720, and the socket 720 is accommodated by the vibration damping member 810. The socket 720 is in electrical communication with the lighting assembly 14 through an electrical connection 820 coupled to the socket 720 and passing through the lighting fixture body 710, and therefore receives the power to supply to the anion bulb 730 through that electrical connection 820. The structure arrangement of the assembly illustrated in FIG. 8 is not necessary in other example embodiments. For instance, the electrical connection 820 may electrically connect the socket 720 to the lighting assembly 14 without passing through the vibration damping member 810, or passing through the lighting fixture body 710 that is adjacent to the vibration damping member 810. Further, as will be discussed later in reference to FIG. 13, the vibration damping member 810 may be provided at other points between socket 720 and the lighting assembly 14 in order to absorb at least some of the vibration produced by the operation of the ceiling fan 12.

Figure 9:
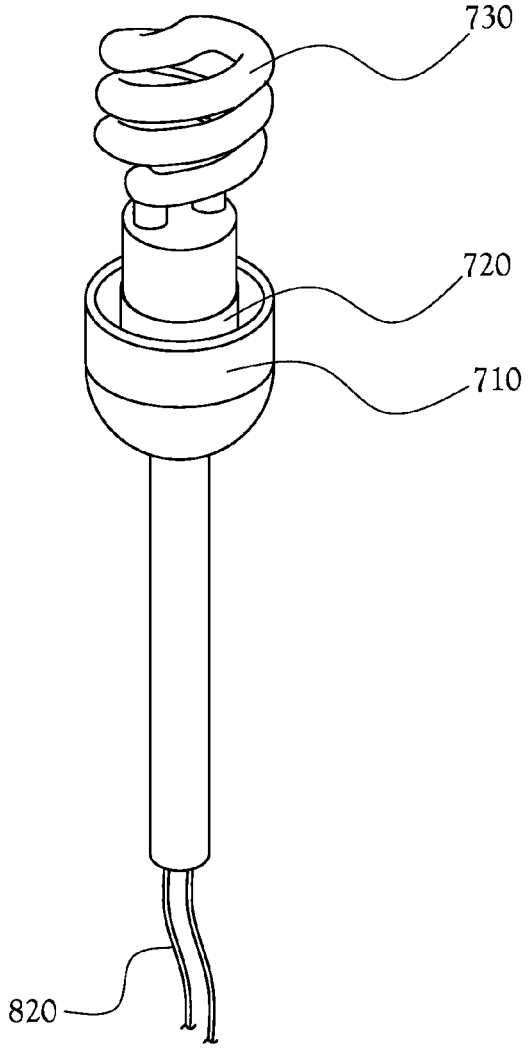
FIG. 9 illustrates an assembled view of the portion of the lighting assembly illustrated in FIG. 8.
Figure 10:
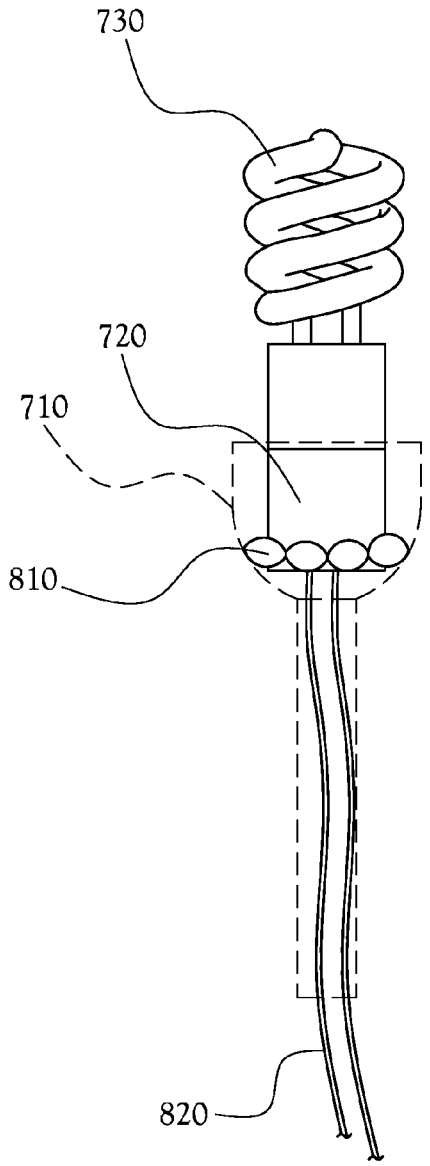
FIG. 10 illustrates a cross section of the lighting fixture body illustrated in FIG. 9.

FIG. 9 illustrates an assembled view of the portion of the lighting assembly illustrated in FIG. 8. As illustrated in FIG. 9, the anion bulb 730 is accommodated in the socket 720, which is in turn accommodated by the vibration damping member 810 inside the lighting fixture body 710. FIG. 10 illustrates a cross section of the lighting fixture body 710 illustrated in FIG. 9. As illustrated in FIG. 10, the vibration damping member 810 is provided in the bottom of a portion of the lighting fixture body 710 that accommodates the socket 720, and rests in between the socket 720 and lighting fixture body 710 to absorb at least some of the vibration transferred to the lighting fixture body 710 from the ceiling fan 12. Without the presence of the vibration damping member 810, the direct contact between the rigid socket 720 and the lighting fixture body 710 would transfer such vibration to the anion bulb 730, which could result in poor performance of the anion bulb 730.

Figure 11B:
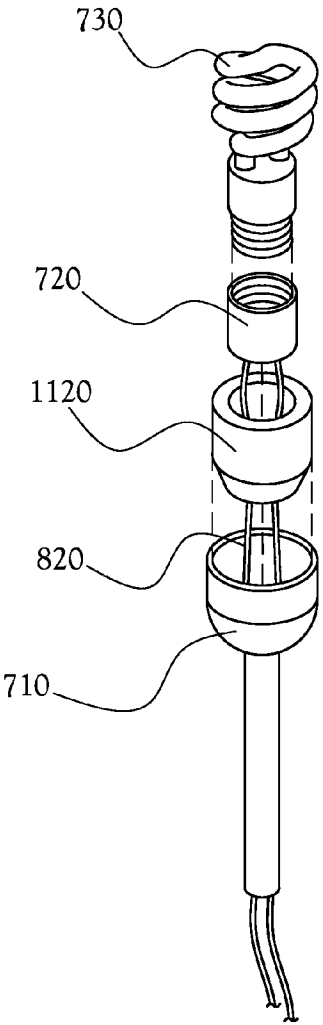
FIGS. 11A-B illustrate exploded views of a portion of the lighting assembly illustrated in FIG. 7 according to other example embodiments of the present general inventive concept.
Figure 11A:
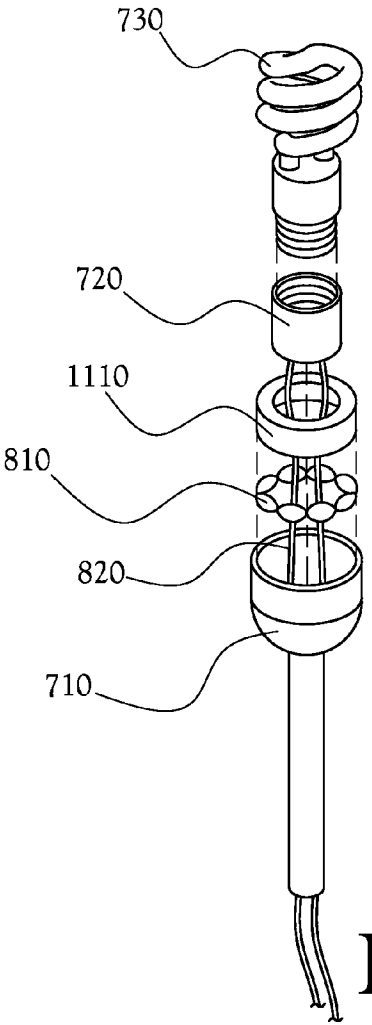

FIGS. 11A-B illustrate exploded views of a portion of the lighting assembly illustrated in FIG. 7 according to other example embodiments of the present general inventive concept. In FIG. 11A, an additional vibration damping member 1110 has been provided to the embodiment illustrated in FIG. 8. The additional vibration damping member 1110 is provided above the vibration damping member 810, and is formed to receive at least a portion of the socket 720 so as to provide additional support for the side of the socket 720. More particularly, in the example embodiment illustrated in FIG. 11A, the vibration damping member 810 is provided so as to rest under the socket 720, and the additional vibration member 1110 provides additional support, as well as vibration damping, between the sides of the socket 720 and the lighting fixgture body 710. In the example illustrated in FIG. 11A, the additional vibration damping member 1110 is formed of a foam substance, but could be formed of any of a number of other substances or combinations of substances, as described earlier in regard to the vibration damping member 810. In FIG. 11B, a single vibration damping member 1120 is provided that supports both the bottom and sides of the socket 720. Thus, the vibration damping member 1120 serves the purpose of both the vibration damping member 810 and the additional vibration damping member 1110 illustrated in FIG. 11A.

Figure 12:
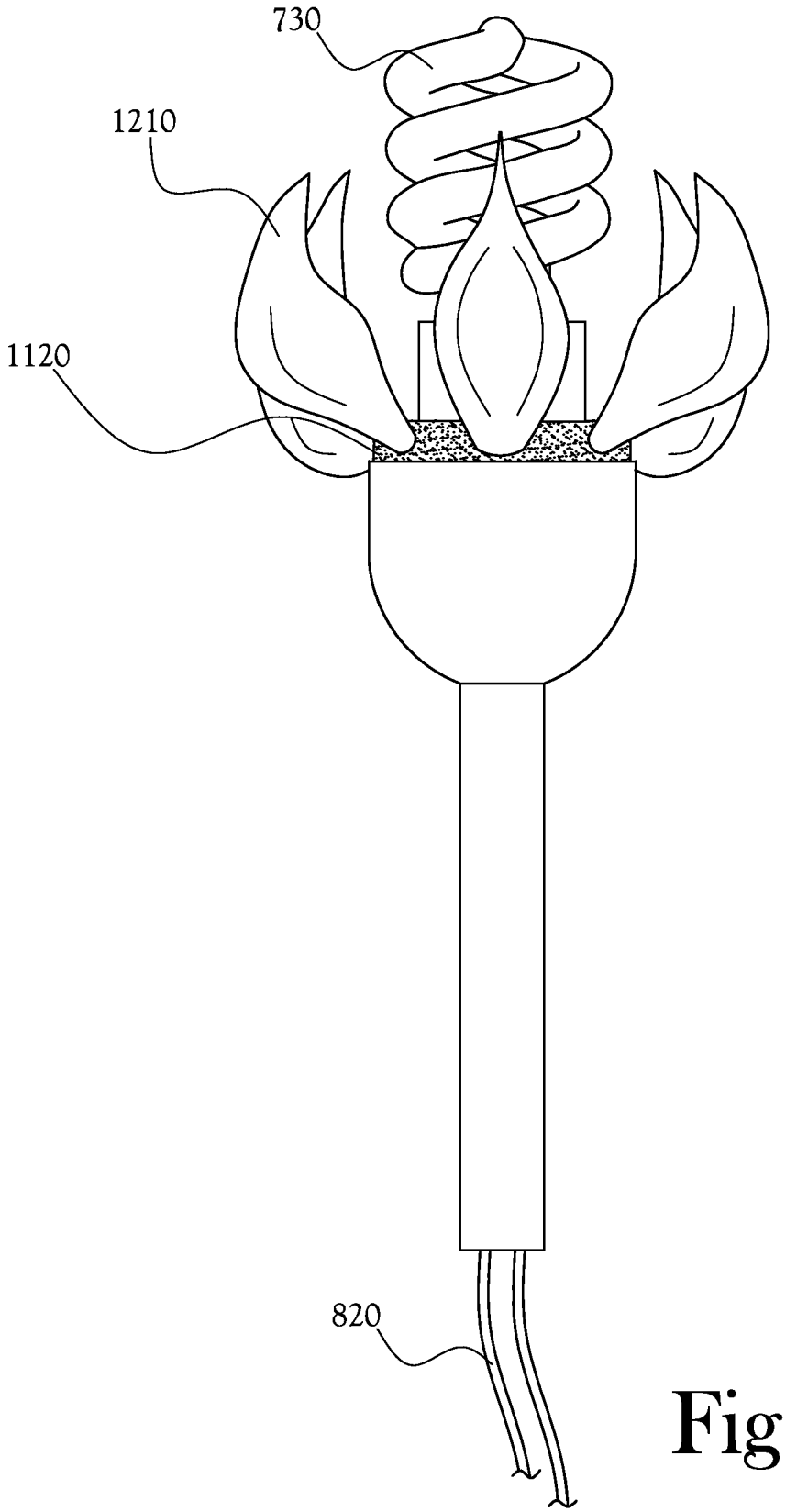
FIG. 12 illustrates an assembled view of the portion of the lighting assembly illustrated in FIG. 11B.

Often, especially in the case of retro-fitting a conventional lighting fixture body to include a vibration damping member, the socket and/or the anion bulb may protrude further from the lighting fixture body than originally intended. Additionally, the vibration damping member itself may protrude in an unsightly fashion from the lighting fixture body in some applications. Thus, while providing vibration damping to aid in the operation of anion bulbs, there may be an aesthetically adverse effect on the fixture. FIG. 12 illustrates an assembled view of the portion of the lighting assembly illustrated in FIG. 11B, which includes the vibration damping member 1120 that provides support to the bottom and sides of the socket 720. The vibration damping member 1120 is formed of a material, such as, for example, any of a variety of foam materials, that will support decorative members 1210 that are coupled to the vibration damping member 1120 itself In the example embodiment illustrated in FIG. 12, the decorative members 1120 are shaped as leaves, and are stuck by the way of pin-like protrusions into the vibration damping member 1120. The leaf-shaped decorative members 1210 are merely one example of the type of decoration which may affixed to the vibration damping member 1120, and other examples may include connecting vine work, and/or other foliage or non-foliage shapes, and may be formed of a variety of materials to suit the aesthetic preferences of the user or manufacturer.

Referring again to FIG. 7, the lighting assembly 14 may be provided with a suspended lighting fixture body 750, such as a lantern-type fixture, which may be suspended, for example, from a central portion of the lighting assembly housing 30. The placement of the suspended lighting fixture body 750 is not limited to that illustrated in FIG. 7, as one or more of such fixtures may also be suspended from ends of the lighting arms 32. In various example embodiments, rather than having a vibration damping member directly adjacent to the socket accommodating the anion bulb, the vibration damping member may be provided at another location between the socket and the connection of the lighting assembly 14 to the ceiling fan 12. For example, the vibration damping member may be provided at the coupling portion from which the suspended lighting fixture body 750 is suspended from the lighting assembly 14.

Figure 13:
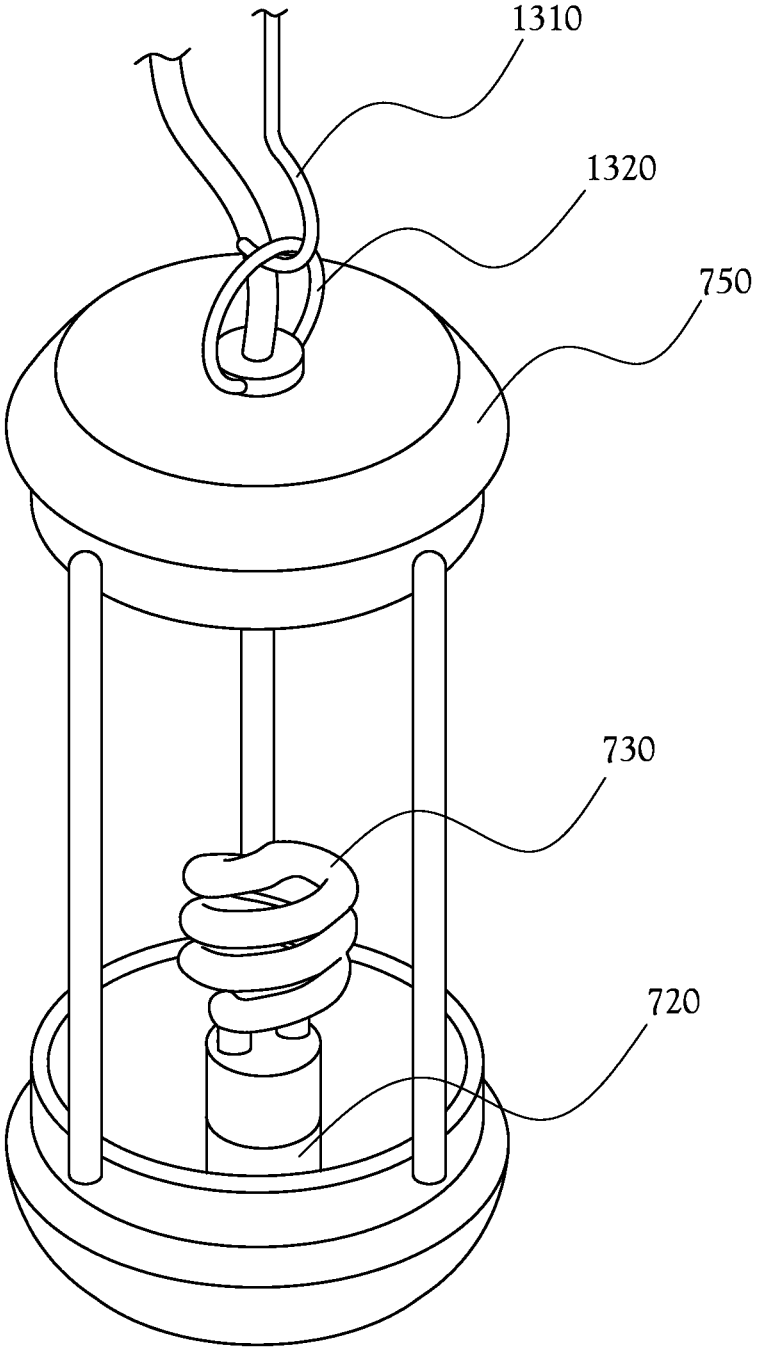
FIG. 13 illustrates the suspended lighting fixture body of FIG. 7 according to an example embodiment of the present general inventive concept.

FIG. 13 illustrates the suspended lighting fixture body 750 of FIG. 7 according to an example embodiment of the present general inventive concept. As illustrated in FIG. 13, the anion bulb 730 is accommodated by the socket 720, which is provided at the base of the suspended lighting fixture body 750. The suspended lighting fixture body 750 is suspended from the lighting assembly 14 by way of a loop 1320 that receives a hook 1310 that is provided to the lighting assembly housing 30. This is merely one example of a way in which the suspended lighting fixture body 750 may be suspended from the lighting assembly housing 30. As another example, the hook 1310 may be provided to the suspended lighting fixture body 750, and the loop 1320 provided to the lighting assembly housing 30. In other various example embodiments, there may be other types of structures to couple the suspended lighting fixture body 750 to the lighting assembly housing 30. In the example embodiment illustrated in FIG. 13, either or both of the hook 1310 and loop 1320 act as the vibration damping member. The hook 1320 and/or loop 1320 may be either formed of one or more vibration damping materials, examples of which have been discussed in the descriptions of the previous drawings, or may be coated with such vibration damping materials. Additionally, the vibration damping material may be self-contained and provided between a contact point of the hook 1310 and loop 1320. In an example embodiment, the hook 1310 may be formed of a vibration damping material such as rubber, which will absorb at least some of the vibration that would otherwise be transferred to the suspended lighting fixture body 750 from the operation of the ceiling fan 12.

While the present invention has been illustrated by description of several embodiments and while the illustrative embodiments have been described in detail, it is not the intention of the applicant to restrict or in any way limit the scope of the appended claims to such detail. Additional modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

The invention claimed is:

1. A lighting assembly for a ceiling fan, the ceiling fan having an attachment interface having an electrical connection for powering an external assembly, the lighting assembly comprising:

a housing configured to be connected to and supported by the attachment interface of the ceiling fan;

an auxiliary connection to provide power to an external device coupled to the housing; and a plurality of lighting arms extending from the housing and respectively provided with a lighting fixture body, a socket to receive a light bulb, the socket being configured to be in electrical communication with the electrical connection of the ceiling fan, and a vibration damping member provided between the lighting fixture body and socket to accommodate the socket.

2. The lighting assembly of claim 1, wherein the vibration damping member is fixed to the lighting fixture body and/or the socket.

3. The lighting assembly of claim 1, wherein the vibration damping member is formed of an elastic polymer, foam material, visco-elastic material, or any combination thereof.

4. The lighting assembly of claim 3, wherein the foam material includes polystyrene foam and/or foam rubber.

5. The lighting assembly of claim 1, wherein a power connection passes from the socket and through the vibration damping member to the electrical connection of the attachment interface.

6. The lighting assembly of claim 1, wherein the lighting fixture body is oriented such that a bulb provided to the socket is maintained at a vertical position.

7. The lighting assembly of claim 1, wherein the vibration damping member is an air and/or liquid filled membrane.

8. The lighting assembly of claim 7, wherein the vibration damping member is segmented to regulate distribution of the air and/or liquid provided within the membrane.

9. The lighting assembly of claim 1, wherein the vibration damping member is coated on the lighting fixture body and/or the socket such that rigid portions of the lighting fixture body and socket do not contact one another.

10. The lighting assembly of claim 1, wherein the vibration damping member supports at least portions of a bottom surface and/or side surface of the socket.

11. The lighting assembly of claim 10, wherein a first vibration damping material supports the at least a portion of the bottom surface of the socket, and a second vibration material supports the at least a portion of the side surface of the socket.

12. The lighting assembly of claim 1, wherein at least a portion of the vibration damping member is formed of a material to support decorative attachments while absorbing at least a portion of vibrations transferred from the ceiling fan.

13. The lighting assembly of claim 1, further comprising decorative members that are readily attachable and detachable to the vibration damping member.

14. A lighting assembly for a ceiling fan, the ceiling fan having an attachment interface having an electrical connection for powering an external assembly, the lighting assembly comprising:

a housing configured to be connected to and supported by the attachment interface of the ceiling fan;

an auxiliary connection to provide power to an external device coupled to the housing;

a lighting fixture body coupled to the housing; and a vibration damping member provided between the lighting fixture body and the housing to absorb at least a portion of vibrations transferred from the ceiling fan;

wherein the lighting fixture body is suspended from housing by the vibration damping member.

15. The lighting assembly of claim 14, wherein the lighting fixture body is a lantern type fixture.

16. The lighting assembly of claim 15, wherein the lighting fixture body is suspended by a hook connection that is coated with a vibration damping material or combination of vibration damping materials.

* * * * *